United States Patent [19]

Hochholzer

[11] Patent Number: 4,812,803

[45] Date of Patent: Mar. 14, 1989

[54] ROTARY POTENTIOMETER, ESPECIALLY FOR USE AS A ROTATIONAL POSITION SENSOR TO DETECT THE ANGULAR POSITION OF A SHAFT

[75] Inventor: Reinhard Hochholzer, Hohenkirchen, Fed. Rep. of Germany

[73] Assignee: Wilhelm Ruf A.G., Hoenkirchen, Fed. Rep. of Germany

[21] Appl. No.: 71,090

[22] Filed: Jul. 8, 1987

[30] Foreign Application Priority Data

Jul. 22, 1986 [DE] Fed. Rep. of Germany ..... 3624640

[51] Int. Cl.[4] ..... H01C 10/34

[52] U.S. Cl. ..... 338/175; 338/167; 338/168

[58] Field of Search ..... 338/175, 162, 163, 164, 338/166, 167, 168, 174

[56] References Cited

FOREIGN PATENT DOCUMENTS 0124346 4/1984 European Pat. Off. .
7216447 8/1972 Fed. Rep. of Germany .
3444229 11/1984 Fed. Rep. of Germany .
2122033 6/1982 United Kingdom .

*Primary Examiner*—E. A. Goldberg
*Assistant Examiner*—M. M. Lateef
*Attorney, Agent, or Firm*—Helfgott & Karas

[57] ABSTRACT

A rotary potentiometer having a casing resistor support held in the casing, a resistor layer on the support, a spring carrier supported for rotation in the casing, and a slider spring fastened at the carrier in sliding contact with the layer. The spring carrier is coupled to a shaft whose angular position is to be detected by the potentiometer.

12 Claims, 7 Drawing Sheets

ROTARY POTENTIOMETER, ESPECIALLY FOR USE AS A ROTATIONAL POSITION SENSOR TO DETECT THE ANGULAR POSITION OF A SHAFT

The instant invention relates to a rotary potentiometer, especially for use as a rotational position sensor to detect the angular position of a shaft, comprising a casing, a resistor support held in the casing, a spring carrier supported for rotation in the casing, a slider spring fastened at the spring carrier and being in sliding electrical contact with a resistor layer on the resistor support, and means for coupling the shaft to the spring carrier.

Various structural embodiments of rotary potentiometers of this kind are commercially available. Typically, the spring carrier they comprise is supported with as little clearance as possible in the casing. When such a rotary potentiometer is to be used as a sensor of the angular position of rotation, such as that of a shaft, a problem is encountered in that the axis of rotation of the rotary potentiometer is not always aligned with the center axis of the shaft. There may be a "center offset" of the two axes. Or the axes may be tilted with respect to each other. This is unsatisfactory both mechanically and electrically. Under mechanical aspects this readily results in destructions. And in electrical respect deviations from linearity and hysteresis may be the consequences. Naturally, this is not acceptable in many cases of application. An example which may be mentioned of such a case of application is the sensing of the position of the throttle flap of an internal combustion engine. In this case a measurement signal is to be provided for control of the point in time of the ignition and/or injection and of the quantity of fuel to be injected.

It is, therefore, an object of the instant invention to improve the rotary potentiometer of the kind mentioned initially such that it will warrant excellent linearity of its electrical output signals with respect to the rotational position even if the axis of rotation of the rotary potentiometer is not aligned with the main axis of a shaft actuating the potentiometer. It is another object of the invention to provide a rotary potentiometer of the kind in question which will have a long service life.

These and other objects which will become apparent as the description proceeds are met, in accordance with the invention, in that the spring carrier is additionally supported for swinging with respect to the resistor support such that its axis of rotation may assume an acute angle with respect to a line perpendicular to the resistor support.

Advantageous modifications and further developments of the invention may be gathered from the subclaims.

The advantages listed below were obtained with a rotary potentiometer according to the invention:

The service life was satisfactory, in other words neither destructions nor electrical deviations occurred at $10^6$ rotary movements throughout the full angular range. The characteristic of the rotary potentiometer was linear all across the angular range, with a tolerance of ±2%. The reproducibility was better than 0.3% and the voltage hysteresis was less than 1.5%. Furthermore, the torque was uniformly linear throughout the range of rotation.

The invention will be described further, by way of example, with reference to the accompanying drawings, in which.

Figure 1:
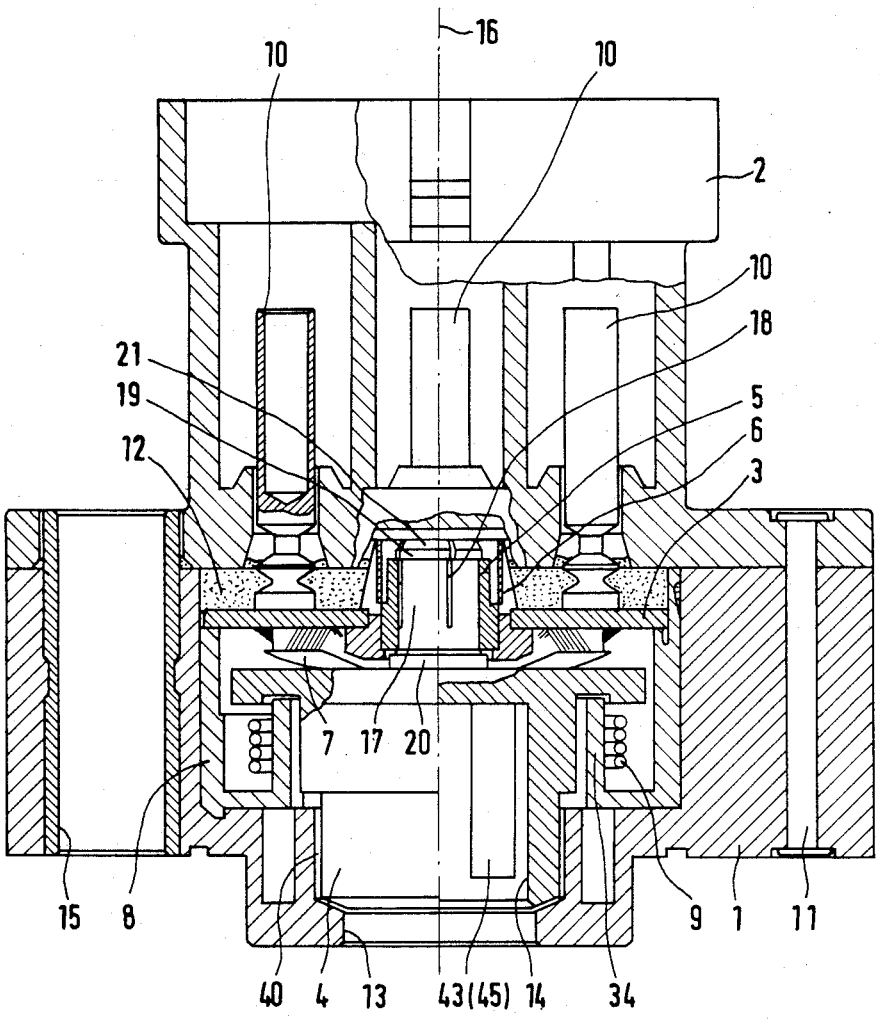
FIG. 1 is a sectional elevation of a rotary potentiometer (along line A—F in FIG. 3)

It should be noted that different scales are used in the various figures.

The rotary potentiometer comprises a casing 1 which is closed by a cover 2 including an integrated terminal board. A resistor support 3 is held stationary inside the casing and it supports a spring carrier 4 for rotational and swinging movement by means of a metal bushing 5 which in turn is retained without clearance by a bearing bushing holder 6 mounted without clearance in an opening formed in the resistor support 3. A slider spring 7, embodied in the instant case by a brush sliding spring, is attached to the spring carrier 4. It is in sliding electrical contact with resistor paths applied on the resistor board by two brushes 57. The resistor support 3 is centered and held firmly in a recess in the casing 1 by means of a "cage" 8 which, at the same time, serves as support of a torsion spring 9 of which one end is fixed to the spring carrier 4. This torsion spring 9 biases the potentiometer into one end position. In the embodiment shown, three plugs 10 are attached by soldering to the resistor support 3. They are connected electrically to the resistor paths mentioned. And they pass through the resistor support 3, being soldered at the side thereof facing the slider spring 7. The cover 2 is fixed to the casing 1 by rivets 11, the remaining cavity between the cover and the side of the resistor support 3 facing it being filled up with a sealing compound whereby the resistor support 3 is in a water-tight capsule with respect to the cover 2.

At its actuating end (the bottom side in FIG. 1) the casing 1 has a central passage opening 13 through which an actuating shaft (not shown) may engage in a blind bore 14 of the spring carrier 4. This actuating shaft is connected to a rotational member whose angular position is to be determined by the rotary potentiometer of the invention. For example, this may be the pivot axis of the throttle flap of an internal combustion engine of which flap the opening position is to be detected. In this event the rotary potentiometer is flange connected to the internal combustion engine by bolts passing through fastening openings 15. It cannot always be guaranteed in practice that the main axis or the axis of rotation 16 of the rotary potentiometer is aligned accurately with the center axis of the rotary actuating shaft. Rather, there may be a so-called center offset between these two axes and/or they may be inclined at an angle with respect to each other. This will produce inaccuracies or linearity errors of the potentiometer with respect to the angular position of the actuating member. Moreover, the stressing of the rotary potentiometer may become excessive and even lead to the destruction thereof.

To overcome those difficulties, the spring carrier 4 is supported for swinging movement with respect to the resistor support 3 so that the axis of rotation of the spring carrier may swing or tumble with respect to the main axis of rotation 16. On the other hand, the spring carrier 4 virtually is constrained in axial direction with respect to the resistor support 3 (only minor axial clearance being provided which is required for the swinging motion). In this manner the contact pressure of the slider spring 7 against the resistor support 3 will suffer only minor variations when the spring carrier 4 is deflected laterally. Consequently the electrical contact resistance between the resistor paths and the slider spring will remain constant within very narrow limits. This is promoted still further by the rather great length of the arms of the slider spring.

The swinging support is accomplished by a flexible journal pin 17 formed integrally with the spring carrier 4 in the embodiment shown. The flexibility of the journal pin 17 is realized by two slots 18 extending in axial direction and being mutually offset in radial direction. These slots permit resilient radial deformations of the journal pin 17 as a result of which the spring carrier can swing with respect to the rigid bushing 5.

In axial direction the journal pin 17 is retained with respect to the bushing 5 by two collars or extensions 19 and 20 which project radially outwardly. By virtue of the slots 18, it is easy to compress the extension 19 at the free end of the journal pin 17 so that it presents no problem to introduce the journal pin 17 into the bushing 5 where it will snap into locking engagement. The introduction is facilitated by a chamfer 21 at the free end of the journal pin. The lower collar or extension 20 acts in the other direction with respect to the opposite end face of the bushing 5. The resiliency of the slider spring 7 urges the spring carrier 4 away from the resistor support 3 to such an extent that the extension 19 of the journal pin 17 will rest against the respective end face of the bushing 5. It may be gathered from FIG. 1 that there is only very little clearance in axial direction between the extension 20 and the corresponding end face of the bushing 5. This little clearance is needed to permit the swinging movement of the journal pin 17.

Figure 11:
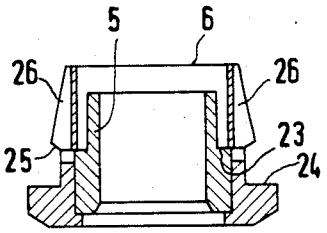
FIG. 11 is a cross sectional elevation of the bearing bushing used with the invention.
Figure 12:
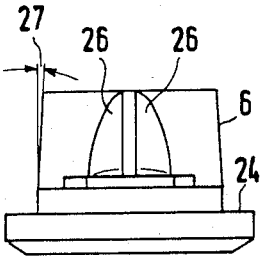
FIG. 12 is a side elevation of the bushing.
Figure 13:
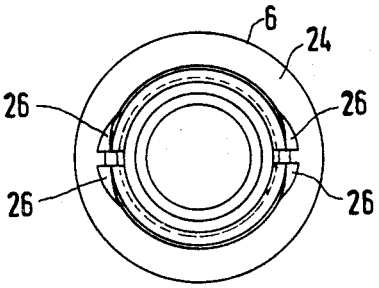
FIG. 13 is a top plan view of the bushing.

In the embodiment shown, the bushing 5 is made of metal for reasons of wear resistance. Easy mounting of the bushing on the resistor support 3 is made possible by introducing it into the bearing bushing holder 6 where it is locked in axial direction between two radially inwardly projecting edges 22 and 23 of the bearing bushing holder 6 (FIG. 11). The bearing bushing holder 6 is made of an elastic material such as plastics. The bearing bushing holder 6 in its turn is snap fitted in an opening formed in the resistor support 3, likewise by two axially spaced edges 24 and 25. The spacing between those edges 24 and 25 corresponds to the thickness of material of the resistor support 3. The bearing bushing holder 6 includes laterally protruding projections 26 at its outside which are inherently elastic and extend obliquely in axial direction. They help to introduce the bearing bushing holder 6 through the opening mentioned in the resistor support 3 and provide the snap fitting of the bearing bushing holder 6 in the resistor support 3. The specific configuration of these projections 26 may be taken from FIGS. 11, 12, and 13. As will be seen, the projections are formed in pairs of mirror symmetry and approximately of half-moon shape, as seen from the top (FIG. 13). Improved clamping action is obtained due to the fact that the edges 25 of the projections facing the resistor carrier 3 are slightly inclined, thus providing some wedging effect. To further facilitate the introduction of the bearing bushing holder 6 into the opening in the resistor support 3, the outer periphery of the upper portion of the bearing bushing holder 6 is designed with a slight conical taper, as expressed by the angle $\alpha$ (in FIG. 12). The arrangement described assures that the bearing bushing is fixed absolutely firmly and without clearance to the resistor support 3.

Figure 9:
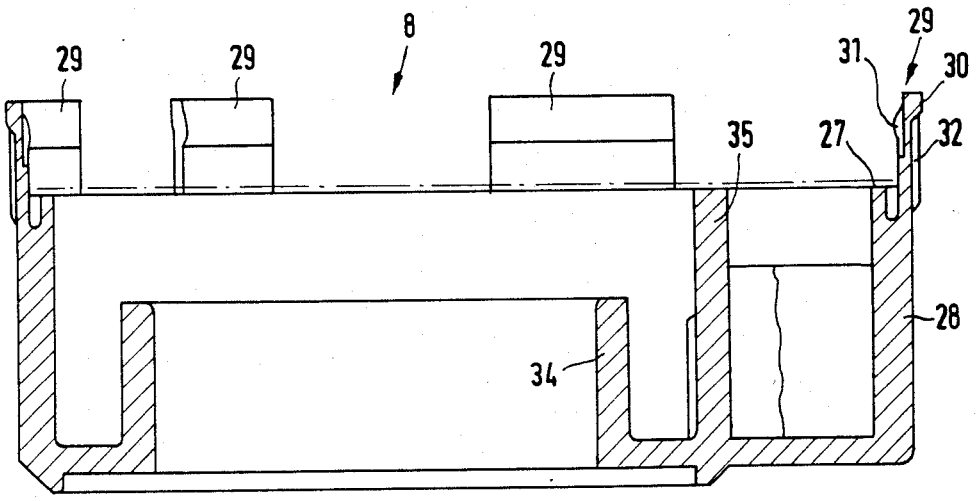
FIG. 9 is a cross sectional elevation of the cage used in the rotary potentiometer to retain and center the resistor board with respect to the casing.
Figure 10:
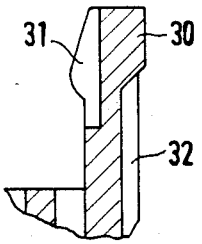
FIG. 10 is an enlarged detail X of FIG. 9.

The resistor support 3 must be retained firmly and correctly aligned with respect to the casing 1 in order that the spring carrier 4 will be aligned centrally with respect to the main axis of rotation 16 of the casing, in normal position, and not suffer any displacements apart from its permitted rotational and swinging movements. To this end, and to facilitate assembling, the resistor support 3 is held in the cage 8 (casing insert). In outline of its outer wall, this case 8 is adapted to the configuration of the resistor support 3 (see also FIGS. 2, 4, and 9). The upper edge 27 of its outer wall 28 serves as base for the resistor support 3. A plurality of spring arms 29 are provided at the outer wall 28 of the cage 8 for retaining and clamping the resistor support 3. They project beyond the upper edge 27, and their inwardly directed surface defines the limit for displacement of the resistor support 3. Moreover, the spring arms 29 have projections 30 which protrude outwardly beyond the outline of the outer wall 28 (see in particular FIG. 10). A central recess in the casing 1 on the other hand is adapted exactly to the outside configuration of the outer wall 28 so that the spring arms 29 are pressed inwardly as the cage 8 is inserted into the central recess of the casing 1. Thus the spring arms are pressed against the end face of the resistor support 3, clamping the same firmly in position (cf. FIGS. 1 and 2). Another means of securing which becomes effective on assembly already when the resistor support 3 is introduced into the cage 8 is presented by inwardly directed projections 31 (see FIG. 10) with which the spring arms 29 are formed and behind which the resistor support 3 becomes locked.

Even more precise centering of the cage 8 in the casing 1 is obtained by additional outwardly projecting ribs 32 formed at the spring arms 29 (see FIG. 10) and being guided in complementary recesses 33 formed in the casing 1. Other than shown in FIGS. 9 and 10, these ribs may extend all the way to the bottom of the cage, whereby in effect they become projections at the outer wall 28 of the cage.

The cage 8 further functions as a retainer of the torsion spring 9. To this end, the cage includes an interior cylindrical sleeve 34 (FIG. 9) spaced from cylindrical portion 35 of outer wall 28 and in axial direction not extending as far as the upper edge 27. The torsion spring 9 is inserted in the intermediate space thus defined. A radially outwardly projecting arm 36 of the torsion spring 9 supports the spring between two ribs 37 and 38 formed integral with the cylindrical portion 35, leaving an aperture for passage of the arm 36 of torsion spring 9 (see FIG. 4). Another axially extending arm 39 of the torsion spring 9 engages in a recess 52 provided at the outer circumference of the spring carrier 4 which thus is biased in one direction of rotation.

Figure 2:
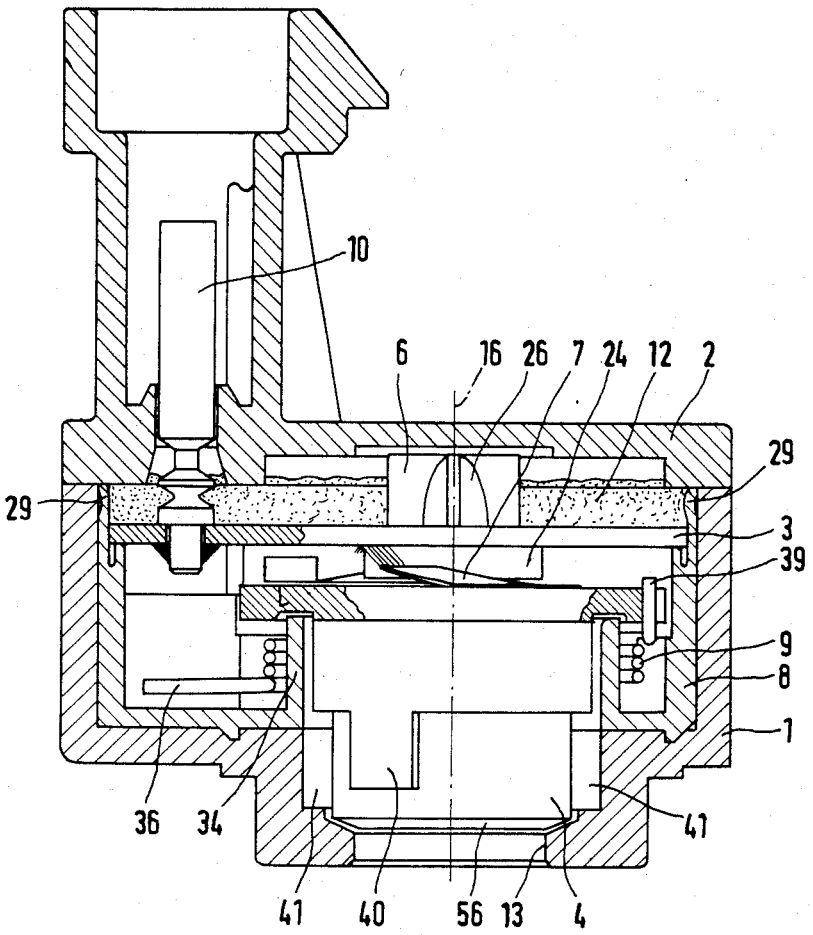
FIG. 2 is another sectional elevation of the rotary potentiometer (along line G—H in FIG. 1)

The upper edge of the sleeve 34 of the cage 8 finally serves as stop for the swinging motion of the spring carrier, as best seen in FIGS. 1 and 2.

At its outer circumference the spring carrier 4 includes one or two stops 40 to limit its rotational movement. It cooperates with a corresponding stop 41 in the central passage opening of the casing 1. In this manner a defined "zero position" of the spring carrier 4 is obtained. The stops moreover may serve to define the range of rotation of the spring carrier 4.

Figure 3:
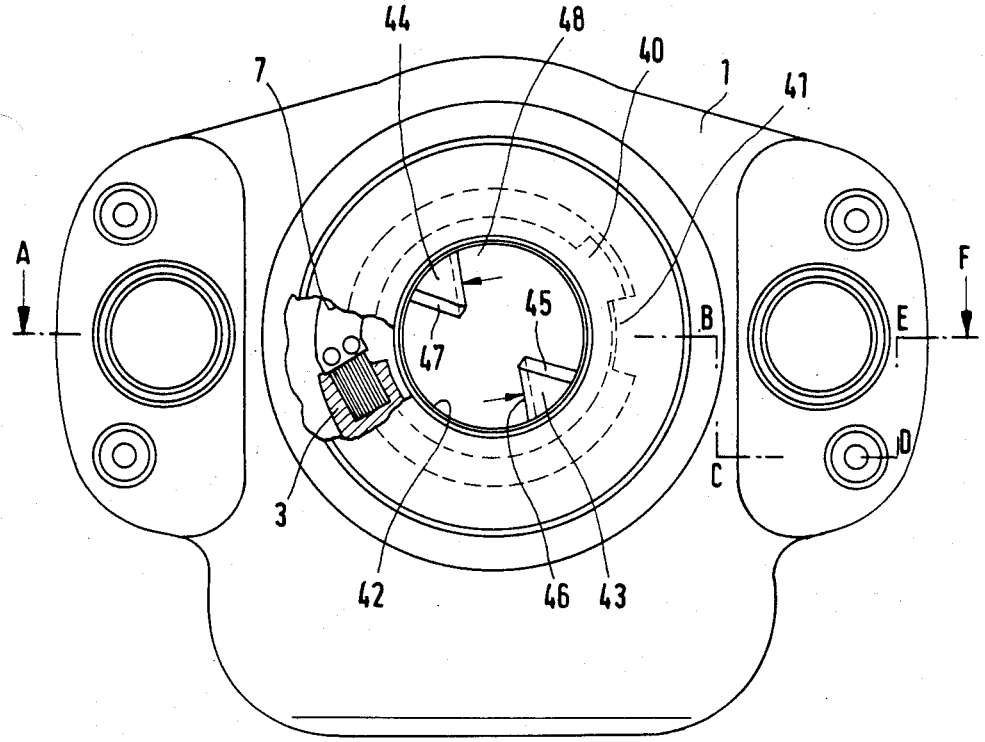
FIG. 3 is a top plan view, partly in section, of the potentiometer, as seen from the rotary actuating end.
Figure 5:
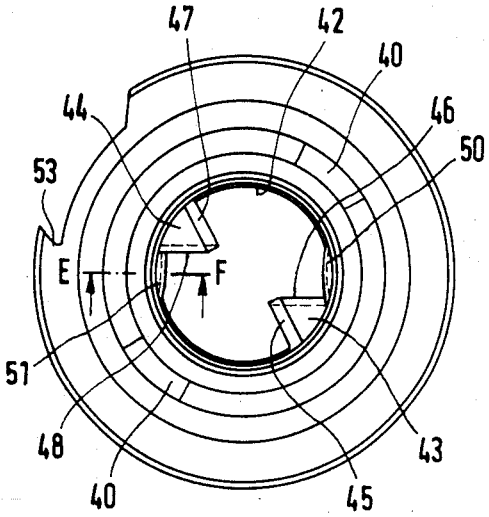
FIG. 5 is a top plan view of the spring carrier used in the rotary potentiometer, as seen from the rotary actuating end.

The connection of the shaft of the actuating member and the spring carrier will now be described with reference to FIGS. 3, 5, and 6. Opposite the central passage opening 13 in the casing 1 the spring carrier 4 is formed with a blind bore 42 into which protrude two entrainment pieces 43 and 44, starting from the cylindrical inner wall of the blind bore 42. The side surfaces 45,46,47, and 48 of the entrainment pieces extend at an inclination with respect to the central axis of rotation 16 (see angle 49 in FIG. 6). As the spring carrier 4 is rotated in counterclockwise sense (see arrows in FIG. 3) by the shaft of the actuating member not presented in the case of the embodiment as illustrated in FIG. 3, planar engaging surfaces of said shaft will come to lie against the side surfaces 46 and 48. As these "abutment" surfaces are undercut, as seen from the top, line contact between the actuating shaft and the abutment surfaces 46 and 48 always is assured even in case of a center offset between the axis of rotation 16 and the center axis of the shaft and also if the axes are inclined with respect to each other. In this manner synchronism between the rotary actuating member and the spring carrier 4 is warranted also in either of the above mentioned faulty conditions. The synchronizing error between driving and driven shafts known with cardan joints thus is avoided. If the entrainment pieces 43 and 44 are taken approximately as triangular prisms, the edges of the prism are inclined at an acute angle 49 (FIG. 6) with respect to the plane defined by a base of the prism and the axis of rotation 16, the angles of inclination of the abutment surfaces 46 and 48 extending in opposed directions. In top plan view, according to FIGS. 3 and 5, both abutment surfaces 46 and 48 thus are "undercut". If each top side of the abutment surfaces 46 and 48 is extended by an imaginary straight line, it will be seen that these two lines do not pass through the center axis of rotation 16 but instead bypass the same at a certain distance. This distance between these two lines corresponds approximately to the thickness of the screwdriver-like tail of the shaft of the actuating member.

The angle of inclination 49 mentioned is in the order of 3° . The respective side surface 45 and 47 shown opposite the abutment surfaces 46 and 48 are likewise inclined correspondingly. In the presentation of FIG. 3, therefore, they are not undercut, in other words, they are visible in FIG. 3.

With reference to the direction of rotation indicated in FIG. 3, the spring carrier 4 presented in FIGS. 5 to 8 is designed for the opposite direction of rotation, in other words it is turned in clockwise sense, as seen from the actuating shaft. Accordingly, the surfaces 45 and 46 as well as 47 and 48 are inverted as compared to FIG. 3. Furthermore, it may be gathered from FIG. 5 that projections 50 and 51 are formed at the inwardly directed wall of the blind bore 42 directly in front of the abutment surfaces 46 and 48, respectively. These projections serves as run up surfaces for the "blade" of the rotary actuating member. The projections 50 and 51 are located directly opposite each other and function to tilt the spring carrier or swing it in the bearing bushing when the actuating member shaft is inclined. The radially inwardly directed surfaces of the projections 50 and 51 likewise are "undercut", i.e. the thickness of the projections decreases constantly from the opening end towards the inside. The angle between these projections and the center axis likewise is about 3° . It may also be taken from FIG. 6 that the blind bore 42 is slightly conically flared towards its open end so as to permit the wobbling movement of the spring carrier with respect to the shaft.

Figure 8:
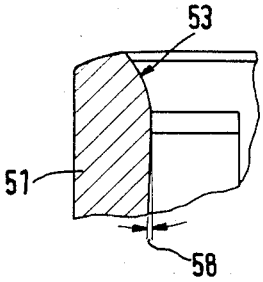
FIG. 8 is a part sectional elevation along line E—F in FIG. 5.

It may be gathered from the enlarged detail of FIG. 8 that the projections 51 (and 50) are rounded (reference numeral 53) toward the opening of the blind bore 42 so as to facilitate the introduction of the shaft of the actuating member.

Figure 4:
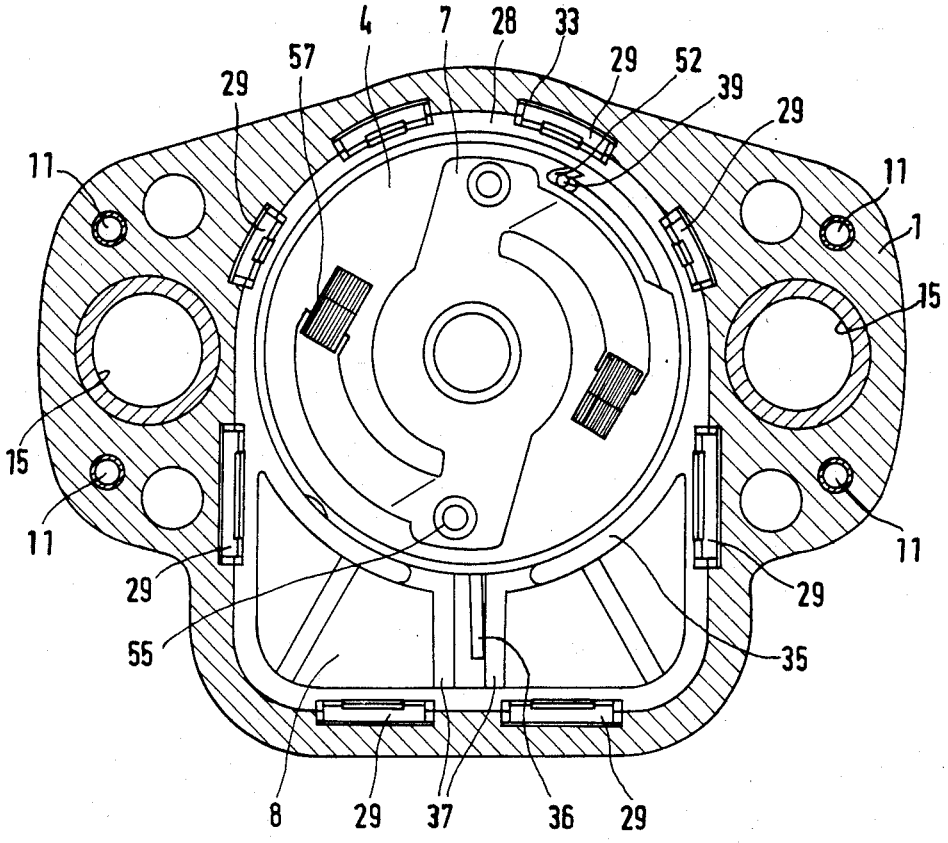
FIG. 4 is another sectional elevation of the rotary potentiometer (along line J—K in FIG. 2) with certain parts (resistor board and bushing) left out for clarity.
Figure 6:
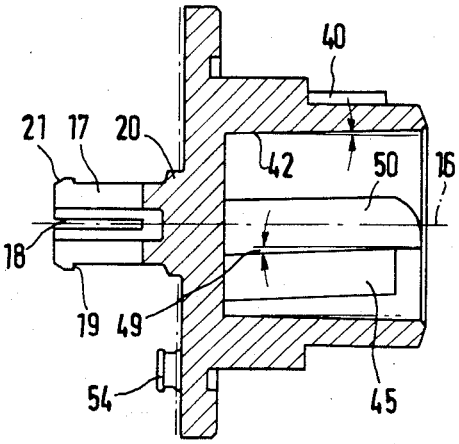
FIG. 6 is a cross sectional elevation of the spring carrier shown in FIG. 5.
Figure 7:
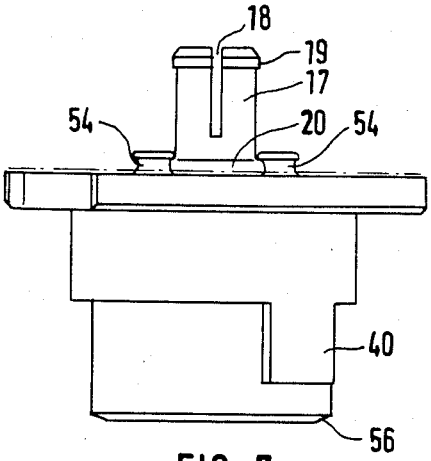
FIG. 7 is a side elevation of the spring carrier shown in FIG. 5.
Figure 14:
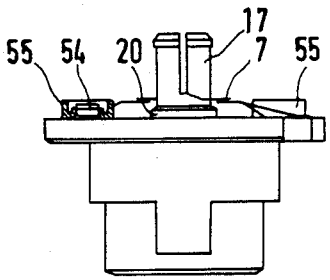
FIG. 14 is a side elevation of the spring carrier with a slider spring attached to it.

Finally, it may be taken from FIGS. 6 and 7 that the rotary spring carrier includes fastening knobs 54 for fixing of the slider spring 7 which are oriented parallel to the journal pin 17. As shown in FIGS. 4 and 14, the slider spring 7 is formed with corresponding apertures to accommodate the fastening knobs 54. A snap ring 55 engaging behind a collar of the fastening knobs 54 retains the slider spring at the spring carrier.

Any technical detail presented in the claims, specification or drawing may be essential of the invention, either alone or in any combination.

What is claimed is:

1. A rotary potentiometer adapted to receive and sense the rotational position of a shaft, the potentiometer having a first axis of rotation, the shaft having a second axis of rotation, said first and second axis being nominally aligned, said potentiometer and said shaft being subject to relative movement at which these axes exhibit relatively small misalignments, said potentiometer comprising:

a casing having a central opening for receiving said shaft, the opening having an axis defining said first axis, the shaft having an axis defining the second axis;

a resistor support held in fixed position within the casing, said support having an electrical resistance layer;

a spring carrier adapted to be coupled to said shaft and disposed in the casing, said carrier being rotatable about a third axis, which when the shaft is not received in the opening is aligned with the first axis;

a slider spring fastened in the casing at the spring carrier and being in sliding contact with said layer; and means disposed in the casing for coupling said carrier to said shaft in a connection at which when said first and second axis of rotation are relatively misaligned, the casing will pivot so that its third axis will intersect the second axis and define a small angle therewith, whereby contact pressure exerted by the spring upon the support remains essentially constant in the presence and absence of said misalignment.

2. The rotary potentiometer as claimed in claim 1, characterized in that the spring carrier (4) comprises a flexible journal pin (17) which is disposed centrically with respect to its axis of rotation (16).

3. The rotary potentiometer as claimed in claim 2, characterized in that the flexible journal pin (17) is retained in a rigid bushing (5) which in turn is fastened to the resistor support (3).

4. The rotary potentiometer as claimed in claim 3, characterized in that the journal pin (17) is constrained (with minor clearance) in axial direction in the bushing (5).

5. The rotary potentiometer as claimed in claim 4 characterized in that the journal pin (17) includes slots (18) which extend in axial direction.

6. The rotary potentiometer as claimed in claim 5, characterized in that the journal pin (17) has a radially projecting extension (19) at its free end, being locked at the face end of the bushing (5).

7. The rotary potentiometer as claimed in claim 6, characterized in that the spring carrier (4) includes a blind bore (42) at its end opposite the journal pin (17), entrainment pieces (43,44) protruding into said blind bore which each have an undercut abutment surface (46, 48) such that engaging surfaces of the shaft will rest against the abutment surfaces (46,48) even if there is a center offset between the shaft and the axis of rotation (16) of the spring carrier (4) and/or an inclination of the axis of the shaft with respect to the axis of rotation.

8. The rotary potentiometer as claimed in claim 7, characterized in that the entrainment pieces (43,44) are shaped approximately like triangular prisms and the edges of the prism are inclined at an acute angle with respect to a plane which includes a base of the prism and the axis of rotation (16).

9. The rotary potentiometer as claimed in claim 8, characterized in that the blind bore has radially inwardly protruding projections (50,51) directly adjacent the abutment surfaces (46,48) of the entrainment pieces (43,44), and that these projections (50,51) have a smaller radial extension than the entrainment pieces and are likewise undercut.

10. The rotary potentiometer as claimed in claim 9, characterized in that the acute angle of the edges of the prisms is in the odder of 3°.

11. The rotary potentiometer as claimed in claim 10, characterized in that the resistor support (3) which carries the bushing (5) for the spring carrier (4) is retained in a casing insert (cage 8) braced by spring arms (29) which are bent as the cage (8) is slipped into the casing (1).

12. The rotary potentiometer as claimed in claim 11, characterized in that the spring carrier (4) has a radius-like chamfer the radius of which starts from the theoretical centering or swinging point of the journal pin (17).

* * * * *